US006295547B1

(12) United States Patent
Zhang et al.

(10) Patent No.: US 6,295,547 B1
(45) Date of Patent: Sep. 25, 2001

(54) FOURIER TRANSFORM APPARATUS

(75) Inventors: Xiaomang Zhang, Tenri; Naoyuki Fukuda, Nara-ken, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/263,484

(22) Filed: Mar. 8, 1999

(30) Foreign Application Priority Data

Mar. 9, 1998 (JP) ..... 10-057128

(51) Int. Cl.[7] ..... G06G 7/19
(52) U.S. Cl. ..... 708/821
(58) Field of Search ..... 708/821, 820, 708/400–409

(56) References Cited

U.S. PATENT DOCUMENTS 5,058,049 * 10/1991 Anderson ..... 708/821
5,959,875 * 9/1999 Kawahara et al. ..... 708/821

FOREIGN PATENT DOCUMENTS 5-174046A 7/1993 (JP) .
5-189470A 7/1993 (JP) .
5-189471A 7/1993 (JP) .

* cited by examiner

*Primary Examiner*—Tan V. Mai

(57) ABSTRACT

A Fourier transform apparatus includes: a signal generating section for generating a plurality of sine-wave signals and a plurality of cosine-wave signals; a plurality of analog circuits each having a respective circuit parameter corresponding to a respective Fourier coefficient, and each receiving the respective sine-wave signal and the respective cosine-wave signal which are generated by the signal generating section; and an operation section for performing an operation on each of outputs of the respective analog circuits and outputting the resultant respective analog signals.

9 Claims, 5 Drawing Sheets

Update timing of Fourier coefficient ($f=f_N$)

Update timing of Fourier coefficient ($f>f_N$)

FOURIER TRANSFORM APPARATUS

BACKGROUND OF THE INVENTION

1. Field of the Invention

The present invention relates to a Fourier transform apparatus for performing Fourier transform used for processes such as signal analysis, signal compression and decoding.

2. Description of the Related Art

Fourier transform is indispensable for the processes such as signal analysis, signal compression and decoding. The Fourier transform is based on the idea that "any periodic function can be represented as the sum of trigonometric functions". A non-periodic signal is considered as a function having an infinite cycle.

Recently, discrete Fourier transform has often been used. A cycle of a sample signal obtained from N sample values of t=0 to t=(N−1) is T=N. A frequency $f_N$ of this signal is given by the following expression (1):

$$f_N=1/N \tag{1}$$

A component of the frequency $f_N$ is a fundamental-wave component, whereby a harmonic-wave component having a frequency k/N equal to the frequency $f_N$ multiplied by an integer can be obtained. By using these frequencies, the following expressions of discrete Fourier transform and inverse discrete Fourier transform can be defined based on the definition of the Fourier transform.

Fourier-transform expression (represented by sine-wave and cosine-wave components):

$$\left.\begin{aligned} a(0) &= \frac{1}{N}\sum_{k=0}^{k=N-1} g(k) \\ a(n/N) &= \frac{1}{N}\sum_{k=0}^{k=N-1} g(k)\cos(-2\pi kn/N) \\ b(n/N) &= \frac{1}{N}\sum_{k=0}^{k=N-1} g(k)\sin(-2\pi kn/N) \end{aligned}\right\} \tag{2}$$

Inverse Fourier-transform expression (represented by sine-wave and cosine-wave components):

$$g(n) = a(0) + \sum_{k=1}^{N-1} a(k/N)\cos(2\pi kn/N) + \sum_{k=1}^{N-1} b(k/N)\sin(2\pi kn/N) \tag{3}$$

where g(n) is a sample signal, and a(n/N) and b(n/N) are Fourier coefficients.

Each of the above expressions, Expressions (2) and (3), is a Fourier expansion expression in which the sine-wave component and cosine-wave component are separated.

Moreover, each of the above Fourier expansion expressions is represented by a complex number by using the following Expression (4):

$$G(n/N)=a(n/N)+jb(n/N) \tag{4}$$

Fourier-transform expression (represented by a complex number):

$$G(n/N) = \frac{1}{N}\sum_{k=0}^{k=N-1} g(k)\exp(-j2\pi nk/N) \tag{5}$$

Inverse Fourier-transform expression (represented by a complex number):

$$g(n) = \sum_{k=0}^{N-1} G(k/N)\exp(j2\pi kn/N) \tag{6}$$

Moreover, G(n/N) and $G_n$, are simplified as g(n) and $g_n$, respectively, and each of the above Fourier-transform expressions is represented by a rotator T given by the following Expression (7):

$$T=\exp(-j2\pi/N) \tag{7}$$

Fourier-transform expression (represented by a rotator):

$$G_n = \frac{1}{N}\sum_{k=0}^{N-1} g_k T^{nk} \tag{8}$$

Inverse Fourier-transform expression (represented by a rotator):

$$g_n = \sum_{k=0}^{N-1} G_n T^{-nk} \tag{9}$$

Each of the above Fourier-transform expressions requires an enormous amount of calculation. Therefore, it is difficult to apply such Fourier-transform expressions directly to an actual operation. As a result, more practical "fast Fourier transform" (hereinafter, simply referred to as "FFT") is used.

The FFT is an algorithm wherein the number of multiplying operations of sample signal $g_k$ and rotator $T^{nk}$ as well as the number of adding and subtracting operations represented by Σ in a transform expression are significantly reduced.

The FFT is applied in a variety of fields, and numerous types of algorithms have been proposed for the FFT. Each such algorithm has respective specific characteristics in terms of simplicity, operation speed, software-program configuration, advantageous property for implementing hardware, or the like. Among these, the FFT with a radix of 2 is most typically used.

The FFT with a radix of 2 is as follows:

First, it is assumed that the number N of sample values is $2^n$ (where n is an integer).

$$\left.\begin{aligned} e(n) &= g(2n) \\ h(n) &= g(2n+1); \quad n = 0, 1, \ldots, N/2-1 \end{aligned}\right\} \tag{10}$$

When a coefficient 1/N is omitted, the following Fourier-transform expression can be obtained:

$$G_k = \sum_{n=0}^{N-1} g_k T^{nk} = \sum_{n=0}^{N/2-1} (e(n)T^{2nk} + h(n)T^{(2n+1)k}) \quad (11)$$

$$G_k \begin{cases} E_k + T^k H_k; & 0 \le k \le \frac{N}{2} - 1 \\ E_{k-N/2} + T^k H_{k-N/2}; & \frac{N}{2} \le k \le N-1 \end{cases} \quad (12)$$

where $$\left.\begin{aligned} E_k &= \sum_{n=0}^{N/2-1} e(n)T^{2nk} \\ H_k &= \sum_{n=0}^{N/2-1} h(n)T^{2nk} \end{aligned}\right\} \quad (13)$$

In the case of, for example, $N=2^{n0}$, this algorithm can be utilized n0 times, as shown in FIG. 7.

In FIG. 7, DFT indicates discrete Fourier transform. In the case of, for example, $N=2^4$, the algorithm is repeated four times.

The algorithm is primarily configured from a basic operation called "butterfly operation". In order to implement the butterfly operation, a bit-reversal method of input data and coefficient is used.

Only the fast Fourier transform has been mentioned herein. The operation of inverse Fourier transform is substantially the same as that of the fast Fourier transform, except that $G_k$ and $g_n$ are exchanged each other. Therefore, description thereof is omitted.

Other specific examples include the techniques disclosed in Japanese Laid-Open Publication Nos. 5-189470, 5-174046 and 5-189471, respectively.

Japanese Laid-Open Publication No. 5-189470 relates to a method for performing time-series data input type Fourier transform, and discloses Fourier transform which is performed in a digital manner. In this method, a number of operation devices and buffers are employed together with the above-mentioned FFT algorithm to perform Fourier transform In real time. This method is characterized in that the process is initiated before all of N data have been collected.

Japanese Laid-Open Publication No. 5-174046 shows a circuit configuration wherein the butterfly operation is performed in a digital manner by using a multiplier or the like as an operation circuit.

In Japanese Laid-Open Publication No. 5-189471, a butterfly-type operation device performs FFT in a pipeline manner by using a bit-reversal addressing technique or the like. This is a typical method for implementing an FFT processor.

The above-mentioned FFT algorithm is not problematic in the case of off-line data analysis using a high-level language. However, in the case where on-line data processing is conducted by using DSP (Digital Signal Processor), that is, in the case where audio data or image data which has been compressed by Fourier transform is reproduced, for example, in real time, the FFT algorithm has some disadvantages as follows:

(1) the algorithm must be changed dependent upon hardware.

Since software is dependent upon the hardware, new software and a new algorithm must be produced when the hardware is changed, whereby the development period is increased;

(2) Since a special operation is performed, data processing other than FFT is adversely affected.

In order to implement the bit-reversal of the butterfly operation, special addressing must be conducted by hardware. Therefore, when general-purpose processes are simultaneously conducted by the same hardware, a long instruction code is required. As a result, the hardware is not efficiently utilized, as well as an instruction-memory capacity is increased, leading to an increase in the cost;

(3) The accuracy is limited by the speed.

In order to increase the processing accuracy, the number of bits must be increased to some extent. According to the FFT algorithm, a number of multiplying and adding operations are performed, whereby the speed (clock) is limited in order to assure carrier processing of such operations; and (4) Power consumption is increased with an increase in clock frequency.

The on-line data processing by DSP must be conducted at a high speed. It is a common technique to increase a clock frequency in order to perform the algorithm at a higher speed. In a digital circuit, however, power consumption is increased proportionally to the increase in a clock frequency. This is not advantageous for portable equipment, since, in the portable equipment, low power consumption is desirable in order to utilize a battery as long as possible.

For example, TMS320C50 by TEXAS INSTRUMENTS INC. requires 28,951 cycles for an FFT operation when the number of sample values is N=64 (which corresponds to 72.38 $\mu$s when a clock frequency is 40 MHz). Similarly, TMS320C50 requires 15,890 cycles when N=256, and 82,761 cycles when N=1,024. Thus, in the case where a number of cycles are required for the operation, a higher clock frequency must be used to increase the processing speed, thereby increasing the power consumption. Accordingly, the general-purpose DSP cannot be used for the portable equipment.

Since each of Japanese Laid-Open Publication Nos. 5-189470, 5-174046 and 5-189471 utilizes a digital processor dedicated to FFT, the same problems as those of the general-purpose DSP arise.

SUMMARY OF THE INVENTION

The Fourier transform apparatus according to the present invention includes: a signal generating section for generating a plurality of sine-wave signals and a plurality of cosine-wave signals; a plurality of analog circuits each having a respective circuit parameter corresponding to a respective Fourier coefficient, and each receiving the respective sine-wave signal and the respective cosine-wave signal which are generated by the signal generating section; and an operation section for performing an operation on each of outputs of the respective analog circuits and outputting the resultant respective analog signals.

With such a configuration, the signal generating section generates the sine-wave signals and cosine-wave signals, and inputs the sine-wave signals and cosine-wave signals to the respective analog circuits. Each of the analog circuits has a respective circuit parameter for Fourier series, and performs an operation of the respective sine-wave signal and the respective cosine-wave signal based on the respective Fourier series. The operation section performs an operation on each of the outputs of the respective analog circuits and outputs the resultant respective analog signals.

Provided that the sine-wave signals and the cosine-wave signals are sine-wave components and cosine-wave components of Expression (3), respectively, each analog signal output from the operation section is a signal g(n) in Expression (3).

In other words, according to the present invention, analog circuitry is employed at least partially in the Fourier transform apparatus, and inverse Fourier transform as defined by the following Expression (3) is performed:

$$g(n) = a(0) + \sum_{k=1}^{N-1} a(k/N)\cos(2\pi kn/N) + \sum_{k=1}^{N-1} b(k/N)\sin(2\pi kn/N) \quad (3)$$

In one example, the signal generating section generates a direct-current signal along with the sine-wave signals and the cosine-wave signals; each of the analog circuits has a respective circuit parameter corresponding to a respective Fourier coefficient, and receives the direct-current signal, the respective sine-wave signal and the respective cosine-wave signal which are generated by the signal generating section; and the operation section performs an operation on each of the outputs of the respective analog circuits and outputs the resultant respective analog signals.

Herein, a direct-current component in the above Expression (3) is also subjected to processing.

In one example, the signal generating section includes a discrete signal processing circuit. For example, the signal generating section includes: a storing section for storing respective values of a plurality of points on a single cycle of a sine wave; a converting section for converting the respective values of the points stored in the storing section to respective signals; a holding section for holding the signals converted by the converting section: and a signal forming section for sequentially outputting the signals held by the holding section during respective distinct cycles, thereby generating the sine-wave signals and cosine-wave signals having respective cycles.

In the case where the signal generating section is a discrete signal processing circuit, a variety of sine-wave signals and cosine-wave signals can be reproduced with a high accuracy by the discrete signal processing circuit.

Moreover, since each of the analog circuits immediately generates a respective output for the respective input (i.e., respective sine-wave signal, cosine-wave signal and direct current), advantages of the discrete signal processing circuit (i.e., high accuracy and flexibility) as well as advantages of the analog circuits (i.e., high-speed processing) can be sufficiently achieved.

In one example, the signal generating section generates a direct-current signal corresponding to constant 1 in a first term of a right side of Expression (3), the plurality of cosine-wave signals corresponding to cos(2πkn/N) in a second term of the right side of the Expression (3), and the plurality of sine-wave signals corresponding to sin(2πkn/N) in a third term of the right side of the Expression (3):

$$g(n) = a(0) + \sum_{k=1}^{N-1} a(k/N)\cos(2\pi kn/N) + \sum_{k=1}^{N-1} b(k/N)\sin(2\pi kn/N). \quad (3)$$

In one example, each of the analog circuits has a circuit parameter corresponding to a Fourier coefficient a(0) in a first term of a right side of Expression (3), a plurality of circuit parameters corresponding to a Fourier coefficient a(k/N) in a second term of the right side of the Expression (3), and a plurality of circuit parameters corresponding to a Fourier coefficient b(k–N) in a third term of the right side of the Expression (3):

$$g(n) = a(0) + \sum_{k=1}^{N-1} a(k/N)\cos(2\pi kn/N) + \sum_{k=1}^{N-1} b(k/N)\sin(2\pi kn/N). \quad (3)$$

In one example, the operation section adds the respective outputs of the analog circuits, thereby outputting an analog signal corresponding to g(n) of a left side of Expression (3):

$$g(n) = a(0) + \sum_{k=1}^{N-1} a(k/N)\cos(2\pi kn/N) + \sum_{k=1}^{N-1} b(k/N)\sin(2\pi kn/N). \quad (3)$$

In one example, each of the circuit parameters of the analog circuits is a resistance value.

In one example, each of the respective resistances of the analog circuits is a variable resistance, and the Fourier transform apparatus further includes a changing section for changing the variable resistances of the respective analog circuits.

Herein, the respective circuit parameters of the analog circuits, that is, the resistances, can be readily changed by the changing section, thereby achieving excellent flexibility.

Thus, the invention described herein makes possible the advantage of providing a Fourier transform apparatus having a reduced number of operations as well as a Fourier transform apparatus capable of rapidly and accurately performing the operations, thereby achieving low power consumption.

This and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described with reference to the accompanying drawings.

Figure 1:
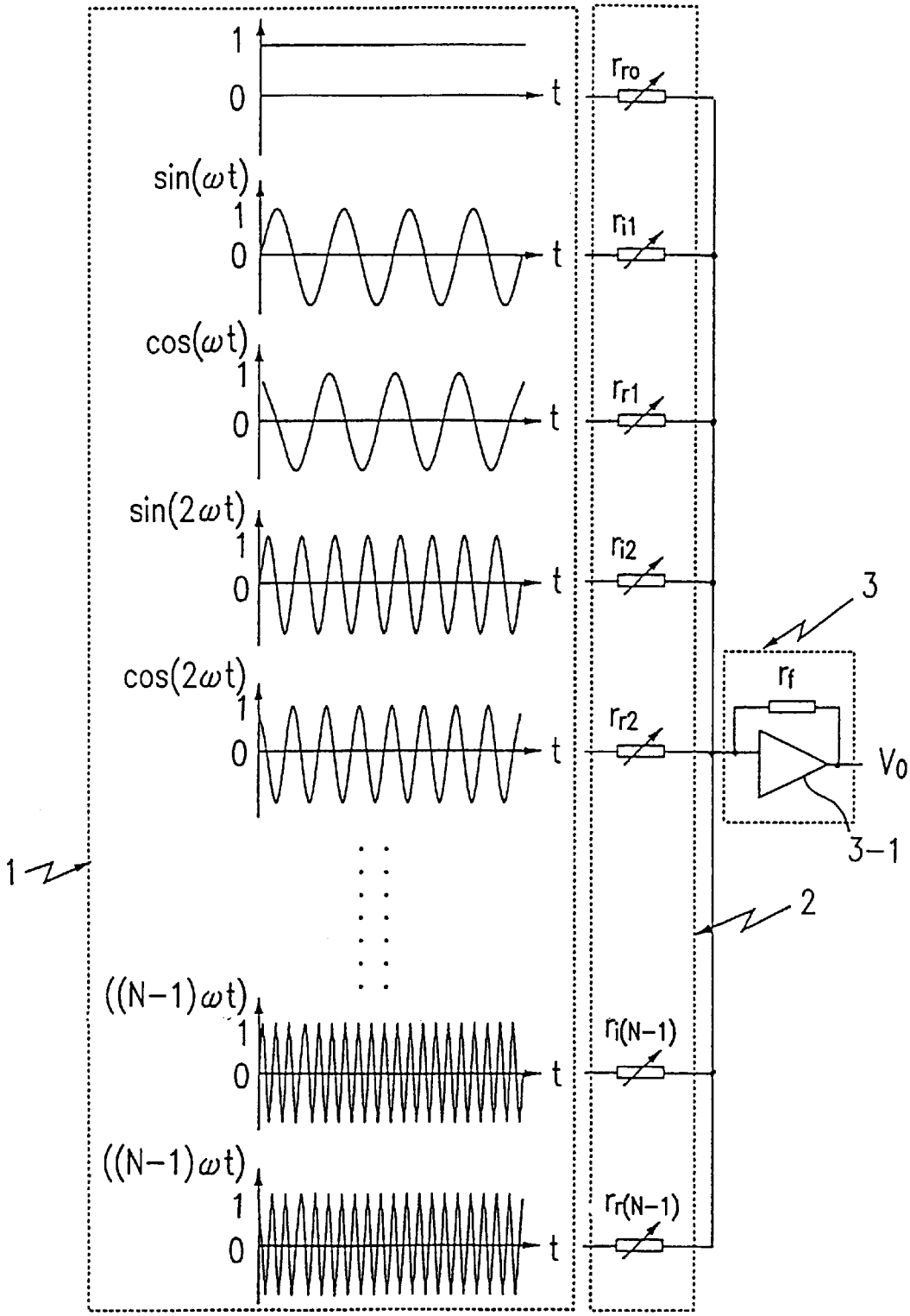
FIG. 1 is a block diagram of a Fourier transfer apparatus according to one example of the present invention.

FIG. 1 shows a Fourier transform apparatus according to one example of the present invention. The Fourier transform apparatus of the present example conducts a process corresponding to inverse Fourier transform given by the above Expression (3), and includes a sine/cosine-wave signal generating section 1, a Fourier coefficient transform section 2 and an adding section 3.

The sine/cosine-wave signal generating section 1 generates an analog direct-current signal and (2N−2) analog sine/cosine-wave signals sin(ωt), cos(ωt), . . . , and outputs these signals.

The Fourier coefficient transform section 2 includes variable resistance sections $r_{r0}$, $r_{i1}$, $r_{r1}$, $r_{i2}$, . . . and $r_{r(N-1)}$ corresponding to respective Fourier coefficients, and changes a resistance of the respective variable resistance sections in response to a change of the respective Fourier coefficients.

The adding section 3 includes an adding circuit 3-1 and a resistor $r_f$. The adding section 3 adds the respective outputs of the variable resistor sections corresponding to the respective Fourier coefficients in the Fourier coefficient transform section 2, and outputs an analog signal indicating the addition result.

The Fourier transform apparatus according to the present example generates an analog direct-current signal and analog sine/cosine-wave signals, and changes a resistance of the respective variable resistance sections in the Fourier coefficient transform section 2 in a stepwise manner, that is, changes the respective Fourier coefficient in a digital manner. Accordingly, this Fourier transform apparatus is herein referred to as an analog/digital-mixed circuit.

It is now assumed that a main frequency f of a sine/cosine-wave signal is equal to a fundamental-wave frequency $f_N$ of a sample signal, as given by the following Expression (14):

$$\left.\begin{aligned} f &= f_N \\ \omega &= 2\pi f \end{aligned}\right\} \tag{14}$$

Figure 2:
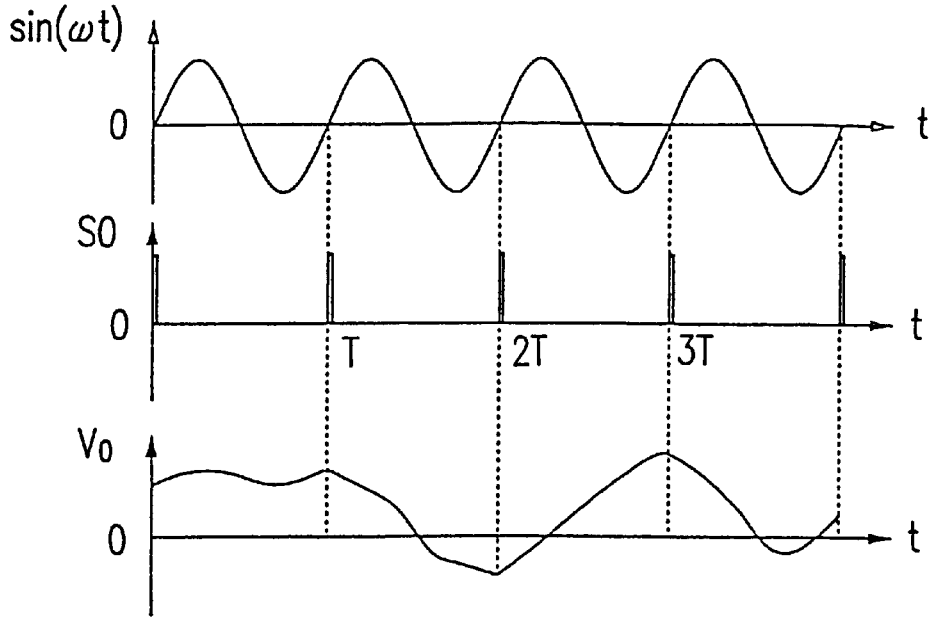
FIG. 2 is a signal timing chart illustrating an operation of the apparatus shown in FIG. 1.

In this case, as shown in the timing chart of FIG. 2, at time t=0, the sine/cosine-wave signal generating section 1 generates a direct-current signal and sine/cosine-wave signals while the Fourier coefficient transform section 2 sets the resistance values of the respective variable resistance sections corresponding to the respective Fourier coefficients. Thereafter, the Fourier coefficient transform section 2 sequentially updates these respective resistance values in every prescribed cycle T=1/f. Thus, the Fourier transform apparatus continuously performs inverse Fourier transform, and outputs a signal $V_0(t)$ from the adding section 3, as given by the following Expression (15):

$$V_0(t) = R_f\left\{\frac{1}{R_{r0}(a_0)} + \sum_{n=1}^{N-1}\frac{1}{R_m(a_n)}\cos(n\omega t) + \sum_{n=1}^{N-1}\frac{1}{R_{in}(b_n)}\sin(n\omega t)\right\} \tag{15}$$

where $R_f$ is a resistance value of the resistor $r_f$, and $R_{r0}$, $R_{i0}$, $R_{r1}$, $R_{i12}$, . . . , and $R_{r1(N-1)}$ are resistance values of the respective variable resistance sections $r_{r0}$, $r_{i0}$, $r_{r1}$, $r_{i12}$, . . . , and $r_{r1(N-1)}$.

As can be seen from the comparison between the above Expressions (3) and (15), the Fourier coefficients a, a/(k/N) and b(k/N) correspond to $R_f/R_{r0}$, $R_f/R_{rn}$ and $R_f/R_{in}$, respectively. Therefore, it can be said that the Fourier transform apparatus of the present example performs inverse Fourier transform.

Also, as indicated by the following Expression (16), it is herein assumed that a main frequency f of each sine/cosine-wave signal is higher than the fundamental-wave frequency $f_N$ of the sample signal as given by Expression (1):

$$\left.\begin{aligned} f &> f_N \\ \omega &= 2\pi f \end{aligned}\right\} \tag{16}$$

Figure 3:
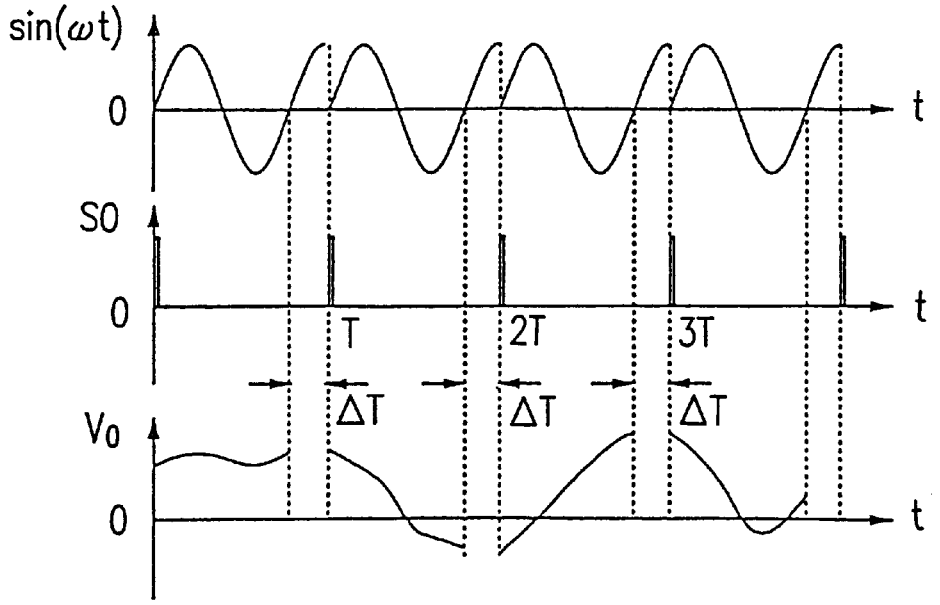
FIG. 3 is a signal timing chart illustrating another operation of the apparatus shown in FIG. 1.

In this case, as shown in the timing chart of FIG. 3, each sine/cosine-wave signal generated by the sine/cosine-wave signal generating section 1 must be reset at every interval T. The output signal $V_0(t)$ of the adding section 3 is valid only during a time period t=iT to (iT−ΔT), as defined by the following Expression (17), where iT is a start time of each cycle T. Thus, another process can be performed during the time period ΔT.

$$V_0(t) = R_f\left\{\frac{1}{R_{r0}(a_0)} + \sum_{n=1}^{N-1}\frac{1}{R_m(a_n)}\cos(n\omega t) + \sum_{n=1}^{N-1}\frac{1}{R_{in}(b_n)}\sin(n\omega t)\right\}; \tag{17}$$

$$(i-1)T \le t \le iT - \Delta T;\ i = 0, 1, \ldots$$

Whichever of Expressions (15) and (17) is used, the signal $V_0$ resulting from the Fourier transform may be used either directly as an analog signal or used after being converted into a digital signal.

Figure 4:
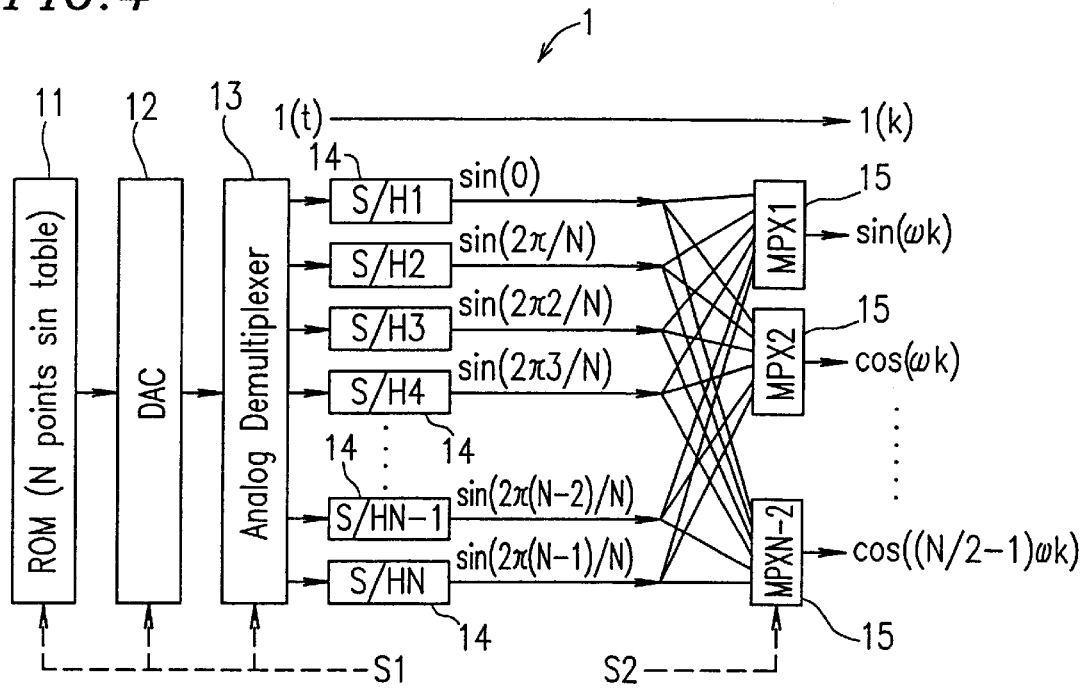
FIG. 4 is a block diagram of a configuration of a sine/cosine-wave signal generating section in the apparatus shown in FIG. 1.

FIG. 4 is a block diagram showing a specific example of the sine/cosine-wave signal generating section 1. In this case, a Shannon sampling theorem is applied, thereby reducing the number of sine/cosine-wave signals required for inverse Fourier transform. Accordingly, the number of variable resistance sections of the Fourier transform section 2 is also reduced.

According to the Shannon sampling theorem, a signal frequency which can be restored is equal to or less than the half of a sampling frequency. The above Expression (3) can be rewritten to the following Expression (18), wherein the upper limit of a variable n of Expression (3) is reduced from N−1 to N/2−1.

$$g(n) = a(0) + \sum_{k=1}^{N/2-1} a(k/N)\cos(2\pi kn/N) + \sum_{k=1}^{N/2-1} b(k/N)\sin(2\pi kn/N) \tag{18}$$

The sine/cosine-wave signal generating section 1 stores respective voltage values at N point(s) on a sine-wave in a ROM (read only memory) 11. It should be noted that the number of points N is desirably $2^n$ (where n is an integer). In such a case, the respective voltage values at the N points become symmetric to each other with respect to the peak of the sine-wave (i.e., the sine wave has the same value on both sides of the peak), whereby the values for the half of each cycle of the sine-wave can be omitted. Therefore, the capacity of the ROM 11 as well as the number of sample holding circuits 14 can be reduced by half.

A sine/cosine value corresponding to the remainder of kn divided by N when kn is out of the range of 0 to (N−1) is defined by the following Expression (19):

$$\sin(2\pi kn/N) \in \{\sin(2\pi m/N)\};$$

$$\cos(2\pi kn/N) \in \{\cos(2\pi m/N\}; \tag{19}$$

k, n, m=0, 1, . . . , N−1

The trigonometric function has the following relation:

$$\cos(\omega t) = \sin(\omega t + \pi/2) \tag{20}$$

A digital/analog converter (DAC) 12 extracts N values on a single cycle of the sine-wave from the sine/cosine-wave signal generating section 1, and converts the extracted values to respective analog signals for output. These analog signals are distributed through an analog demultiplexer 13 to N sample holding circuits 14, respectively.

N/2−1 multiplexers 15 sequentially extract the respective analog signals from the respective sample holding circuits 14 in a preset order so as to output, at a respective timing, the voltage values of the respective sine-waves having the respective cycles, thereby generating N/2−1 sine-wave signals. Moreover, the other N/2−1 multiplexers 15 extract the respective analog signals from the respective sample holding circuits 15 and output the extracted analog signals in the respective cycles, thereby generating N/2−1 cosine-wave signals.

Thus, the multiplexers 15 sequentially extract the analog signals from the respective sample holding circuits 14 and output the extracted signals, thereby producing 2(N/2−1) sine-wave signals and 2(N/2−1) cosine-wave signals.

In the sine/cosine-wave signal generating section 1 as shown in FIG. 4, a frequency of the sine/cosine-wave signal is not particularly limited. A direct current signal is separately produced for output. S1 indicates a synchronization signal for refreshing the sample holding circuits 14. S2 indicates a synchronization signal of the multiplexers 15.

The synchronization signal S2 is synchronized with the fundamental-wave frequency $f_N$ of the sample signal as given by Expression (1) so as to make the fundamental-wave frequency $f_N$ equal to the main frequency f of the sine/cosine wave signal. In this case, as shown in the timing chart of FIG. 2, the direct-current signal and sine/cosine-wave signals are generated by the sine/cosine-wave signal generating section 1.

Moreover, the cycle of the synchronization signal S2 is reduced so as to make the main frequency f of the sine/cosine-wave signal shorter than the fundamental-wave frequency $f_N$ of the sample signal. In this case, as shown in the timing chart of FIG. 3, the output signal $v_0(t)$ of the adding section 3 is valid only during a time period t=iT to (iT−ΔT), where iT is a start time of each cycle T. Accordingly, in the case where the output signal $V_0(t)$ of the adding section 3 is received by a receiving section (not shown) only during the time period of iT to (iT−ΔT) in synchronization with the synchronization signal S2, a signal having the same frequency spectrum as that of the sample signal can be restored. As a result, the receiving section can carry out another process during the time period ΔT.

In the above example, each sine/cosine-wave signal is output in a diverse manner in synchronization with the timing signal S2. However, the present invention can be implemented even when a sine/cosine wave signal as a continuous analog waveform is used.

Figure 5:
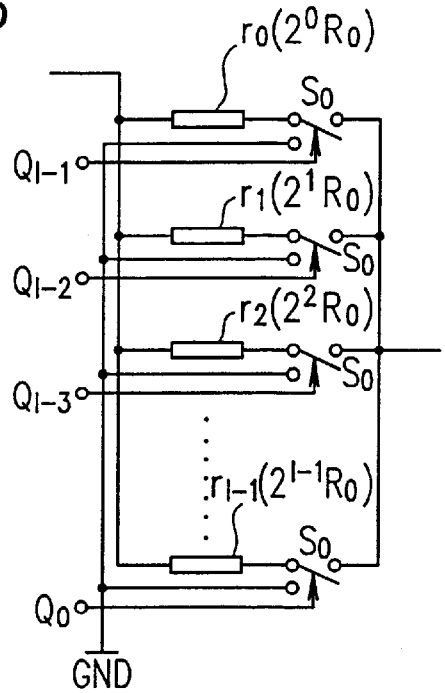
FIG. 5 is a block diagram showing one example of variable resistance sections of a Fourier coefficient transform section in the apparatus shown in FIG. 1.

FIG. 5 is a block diagram showing a specific example of the variable resistance sections of the Fourier coefficient transform section 2.

Each variable resistance section is of a current-adding type, and includes a single resistor $r_0, r_1, \ldots, r_{(l-1)}$ and a single switch $S_0$. Each switch $S_0$ receives a respective 1-bit $Q_{l-1}, Q_{l-2}, \ldots, Q_0$, and is turned ON or OFF depending upon the received bit value. By selectively turning ON the switches $S_0$, resistance values of the respective variable resistance sections corresponding to the respective Fourier coefficient $Q_m$ are set.

When 1-bit of data representing the respective Fourier coefficient Qm is applied to the respective variable resistance sections, the relation among the respective resistance values $2^0$R0, $2^1$R0, . . . , $2^{(l-1)}$R0, the Fourier coefficient Qm and their equivalent resistances is given by the following Expression (21):

$$R_e = R_0 \Big/ \sum_{m=0}^{l-1} 2^{m-(l-1)} Q_m \tag{21}$$

where Qm is a Fourier coefficient, and m=0, 1, . . . , l−1.

Figure 6:
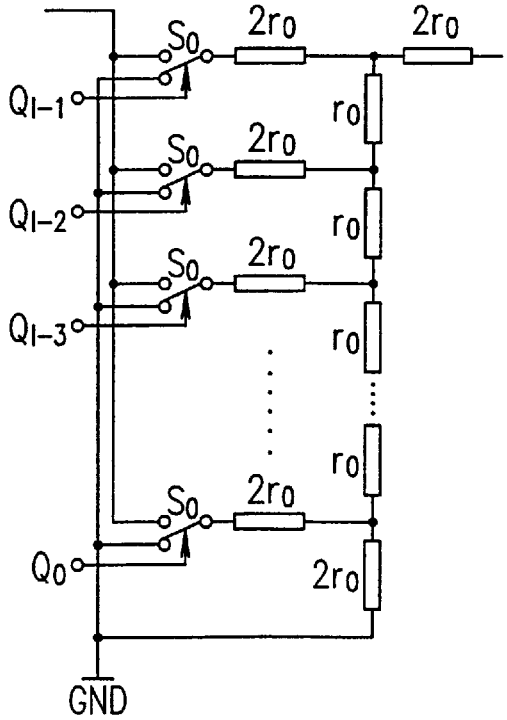
FIG. 6 is a block diagram showing another example of the variable resistance sections of the Fourier coefficient transform section in the apparatus shown in FIG. 1.
Figure 7:
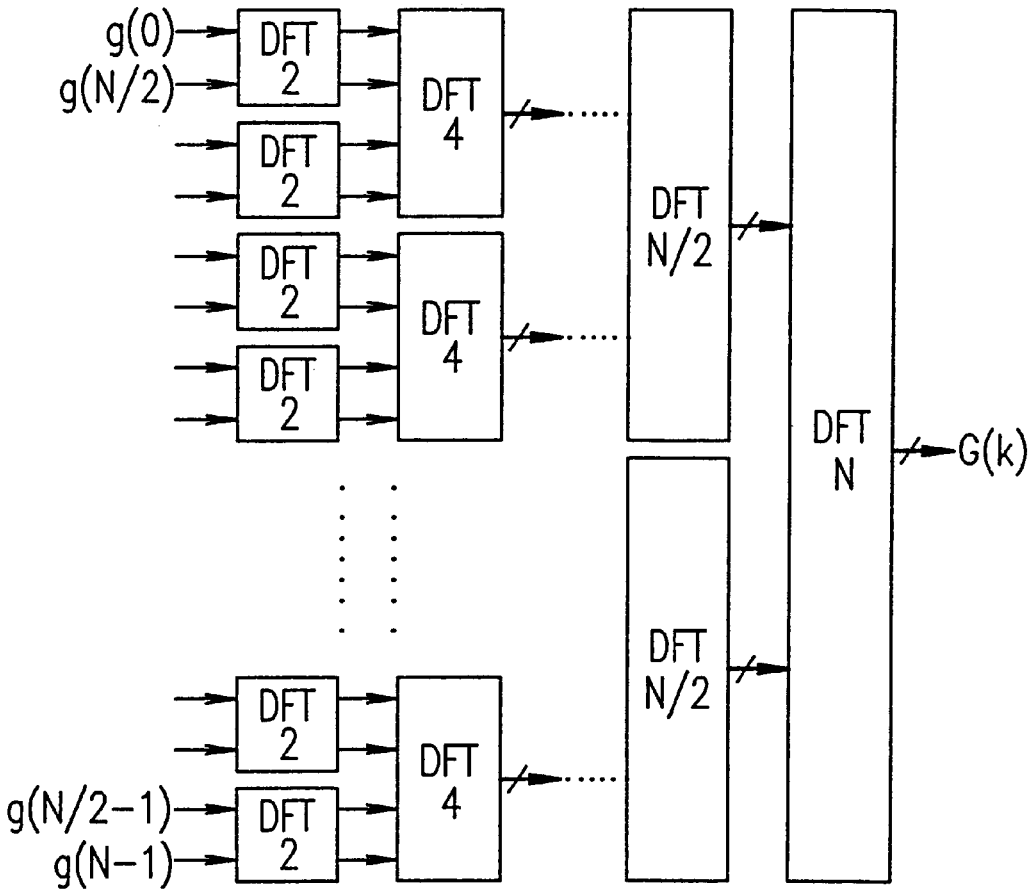
FIG. 7 is a schematic block diagram of a conventional apparatus for performing an FFT operation.

FIG. 6 is a block diagram showing another specific example of the variable resistance sections in the Fourier coefficient transform section 2.

Each variable resistance section is of a voltage-adding type, and includes a single resistor $r_0$, (l+1) resistors $2r_0$, and a single switch $S_0$. Each switch $S_0$ is turned ON or OFF in response to respective 1-bit $Q_{l-1}, Q_{l-2}, \ldots, Q_0$ which indicates a respective Fourier coefficient $Q_m$. By selectively turning ON the switches $S_0$, resistance values of the respective variable resistance sections corresponding to the respective Fourier coefficient $Q_m$ are set.

When 1-bit of data representing the respective Fourier coefficient $Q_m$ is applied to the respective variable resistance sections, the relation among the resistance values $R_0$ and $2R_0$ ($R_0=2R_0/2$) of the respective resistors $r_0$ and $2r_0$, the Fourier coefficient $Q_m$ and their equivalent resistances is given by the following Expression (22):

$$R_e = 6R_0 \Big/ \sum_{m=0}^{l-1} 2^{m-(l-1)} Q_m \tag{22}$$

where $Q_m$ is a Fourier coefficient, and m=0, 1, . . . , l−1.

It should be noted that the present invention is not limited to the above-described example, and various modifications can be made to the present invention. For example, in place of the variable resistance sections of the Fourier coefficient transform section 2, other types of circuits (e.g., circuits for converting a Fourier coefficient to a capacitance by capacitive coupling) may be provided. However, in the case where a capacitance and/or a inductance are used, high-speed operation and high accuracy cannot be sufficiently realized due to the large inertia (such as residual voltage). Therefore, it is desirable to use a variable resistance.

As can be seen from the foregoing, according to the present invention, analog circuitry is employed at least partially in the Fourier transform apparatus. Therefore, the inverse Fourier transform as defined by the above Expression (3) can be performed.

With such a configuration, the Fourier transform apparatus does not rely on software. Therefore, the Fourier transform can be performed only by dedicated hardware, eliminating the need for software development. Thus, the development period is not increased in this respect.

Moreover, since no special operation is performed, the cost of the apparatus can be reduced.

Furthermore, since the operation is not repeated, a clock frequency need not be increased in order to improve the processing accuracy, whereby the power consumption is not increased.

According to the present invention, when the number of sample values is N=64, the number of cycles required for the FFT operation is 64. Similarly, the number of cycles required for the FFT operation is 256 when N=256, and 1,024 when N=1,024. This indicates that the required number of cycles in the present invention is reduced to the range of 1/45 to 1/80 of the required number of cycles in the above-mentioned general-purpose DSP. Therefore, the power consumption can be significantly reduced.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A Fourier transform apparatus, comprising:

a signal generating section for generating a plurality of sine-wave signals and a plurality of cosine-wave signals;

a plurality of analog circuits each having a respective circuit parameter corresponding to a respective Fourier coefficient, and each receiving the respective sine-wave signal and the respective cosine-wave signal which are generated by the signal generating section; and an operation section for performing an operation on each of outputs of the respective analog circuits and outputting the resultant respective analog signals.

2. A Fourier transform apparatus according to claim 1, wherein the signal generating section generates a direct-current signal along with the sine-wave signals and the cosine-wave signals, and each of the analog circuits has a respective circuit parameter corresponding to a respective Fourier coefficient, and receives the direct-current signal, the respective sine-wave signal and the respective cosine-wave signal which are generated by the signal generating section; and the operation section performs an operation on each of the outputs of the respective analog circuits and outputting the resultant respective analog signals.

3. A Fourier transform apparatus according to claim 2, wherein the signal generating section generates the direct-current signal corresponding to constant 1 in a first term of a right side of Expression (3), the plurality of cosine-wave signals corresponding to cos(2πkn/N) in a second term of the right side of the Expression (3), and the plurality of sine-wave signals corresponding to sin(2πkn/N) in a third term of the right side of the Expression (3):

$$g(n) = a(0) + \sum_{k=1}^{N-1} a(k/N)\cos(2\pi kn/N) + \sum_{k=1}^{N-1} b(k/N)\sin(2\pi kn/N). \quad (3)$$

4. A Fourier transform apparatus according to claim 2, wherein each of the analog circuits has a circuit parameter corresponding to a Fourier coefficient a(0) in a first term of a right side of Expression (3), a plurality of circuit parameters corresponding to a Fourier coefficient a(k/N) in a second term of the right side of the Expression (3), and a plurality of circuit parameters corresponding to a Fourier coefficient b(k/N) in a third term of the right side of the Expression (3):

$$g(n) = a(0) + \sum_{k=1}^{N-1} a(k/N)\cos(2\pi kn/N) + \sum_{k=1}^{N-1} b(k/N)\sin(2\pi kn/N). \quad (3)$$

5. A Fourier transform apparatus according to claim 2, wherein the operation section adds the respective outputs of the analog circuits, thereby outputting an analog signal corresponding to g(n) of a left side of Expression (3):

$$g(n) = a(0) + \sum_{k=1}^{N-1} a(k/N)\cos(2\pi kn/N) + \sum_{k=1}^{N-1} b(k/N)\sin(2\pi kn/N). \quad (3)$$

6. A Fourier transform apparatus according to claim 1, wherein the signal generating section includes a discrete signal processing circuit.

7. A Fourier transform apparatus according to claim 6, wherein the signal generating section includes a storing section for storing respective values of a plurality of points on a single cycle of a sine wave;

a converting section for converting the respective values of the points stored in the storing section to respective signals;

a holding section for holding the signals converted by the converting section; and a signal forming section for sequentially outputting the signals held by the holding section during respective distinct cycles, thereby generating the sine-wave signals and cosine-wave signals having respective cycles.

8. A Fourier transform apparatus according to claim 1, wherein each of the circuit parameters of the analog circuits is a resistance value.

9. A Fourier transform apparatus according to claim 8, wherein each of the respective resistances of the analog circuits is a variable resistance, the Fourier transform apparatus further comprising:

a changing section for changing the variable resistances of the respective analog circuits.

* * * * *